United States Patent [19]

Roelofs et al.

[11] Patent Number: 4,592,641

[45] Date of Patent: Jun. 3, 1986

[54] IMAGE TRANSFER DEVICE

[75] Inventors: Johannes C. H. Roelofs, Gennep; Bastiaan B. B. Eertink, Grubbenvorst; Petrus A. M. Geurts, Helden, all of Netherlands

[73] Assignee: Oce-Nederland B.V., Venlo, Netherlands

[21] Appl. No.: 717,322

[22] Filed: Mar. 29, 1985

[30] Foreign Application Priority Data

Mar. 30, 1984 [NL] Netherlands ..... 8401011

[51] Int. Cl.[4] ..... G03G 15/16

[52] U.S. Cl. ..... 355/3 TR; 355/14 TR; 355/3 BE; 355/16

[58] Field of Search ..... 355/3 TR, 14 TR, 3 BE, 355/16; 101/DIG. 13; 198/575, 577

[56] References Cited

U.S. PATENT DOCUMENTS

| | | | |
|---|---|---|---|
| 4,068,937 | 1/1978 | Willemse et al. | 355/3 TR |
| 4,183,658 | 1/1980 | Winthaegen et al. | 355/3 BE |
| 4,541,709 | 9/1985 | Kampschreur | 355/3 TR |

FOREIGN PATENT DOCUMENTS

| | | | |
|---|---|---|---|
| 54-99642 | 8/1979 | Japan | 355/3 BE |

*Primary Examiner*—Arthur T. Grimley
*Assistant Examiner*—J. Pendegrass
*Attorney, Agent, or Firm*—Reed Smith Shaw & McClay

[57] ABSTRACT

A device for transferring an image present on a belt (1) driven at a first speed to an intermediate support (14) driven at a second speed. A pressing element (28) keeps the belt (1) and the intermediate support (14) in contact with one another during the image transfer, the belt (1) assuming the speed of the intermediate support (14) in the contact zone under the influence of frictional forces. A belt storage device (27,33) disposed between the belt drive means (7,8) and the contact zone stores the length difference arising from the difference in the belt speed at the belt drive means and at the contact zone. The belt length present in the belt storage device (27,33) is measured. The speed of the intermediate support (14) is controlled in dependence on the length measured.

5 Claims, 17 Drawing Figures

IMAGE TRANSFER DEVICE

FIELD OF THE INVENTION

The present invention relates to means for transferring image information present on a belt to an intermediate support, and, in particular, means for transferring an image on a photoconductive belt of an electrophotographic device.

BACKGROUND OF THE INVENTION

The present invention relates to a means for transferring an image from a belt to an intermediate support means. In particular, to a transfer means for use in electrophotographic devices such as photocopy machines. In general, transfer devices to which the invention relates are well known in the art, for example, U.S. Pat. Nos. 3,630,615 and 4,371,251. However, unlike the present invention, the devices disclosed in the prior inventions do not have belt storage devices. GB Patent Specification No. 20 17 584 A discloses the use of a belt storage device, but does not have a belt guide roller.

The present invention, on the other hand, is provided with a first drive means which moves the belt at a first speed, a second drive means which moves the intermediate support at a second speed, and a pressure means for bringing the belt into intimate contact with the intermediate support. In response to said contact, the belt assumes the same speed as the intermediate support by virtue of the frictional forces, and the image is thereby transferred from the belt to the intermediate support. A storage device is disposed between the drive means and the pressure means which stores the length difference arising from the difference in the belt speed at the first drive means and at the pressure means.

A device having a belt storage device provided with a guide roller freely movable in one direction is shown in U.S. Pat. No. 4,183,658. However, the disadvantage of the device described therein is that only images of restricted length can be transferred with it, because of the finite storage capacity of the belt storage device. This is particularly disadvantageous in an image-forming device in which long images have to be transferred, e.g., an image-forming device for copying working drawings, in which the length of the images to be transferred may be as much as one meter or more.

Accordingly, it is an object of the invention to provide a measuring means which delivers a measurement signal which is a measurement of the belt length present in the storage device, and an adjusting means to adjust the second speed dependent upon the length represented by the measurement signal.

Generally, the present invention provides a device for transferring image information present on a belt to an intermediate support, comprising a first drive means which propels the belt at a first speed, a second drive means which propels the intermediate support at a second speed; a pressing element for placing said belt in pressure contact with the intermediate support, whereby said belt assumes the speed of said intermediate support and transfers the image information from said belt to the intermediate support; a belt storage device disposed between the drive means and the pressing element for storing the length difference arising from the difference in the belt speed at the first drive means and at the pressing element, a measuring device to provide a measurement signal which is a measurement of the belt length present in the storage device and an adjusting means which adjusts the second speed in dependence on the length represented by the measurement signal.

SUMMARY OF THE INVENTION

According to the invention, the belt length present in the storage device varies during the time interval in which the transfer of the image information takes place; hence, the measurement signal delivered by the measuring device also varies, as a result of a difference between the first and second speeds.

Consequently, the adjustment of the second speed changes and continues to change until the measurement signal reaches a value at which the adjusted speed is equal to the first speed. From that time on, the belt length present in the storage device remains constant. In this way, an image of arbitrary length can be transferred by means of an image transfer device using belt storage device of small storage capacity.

Other advantages of the invention will become apparent from a perusal of the following detailed description of a presently preferred embodiment taken with reference to the accompanying drawings.

DESCRIPTION OF A PRESENTLY PREFERRED EMBODIMENT

A. The copying machine

The following is a description of a copying machine embodying a photoconductive belt which moves past a number of processing stations including a charging and developing station and a transfer station. While a particular machine is described in detail to fully understand the operation and advantages of the invention, it is to be understood that this invention may be likewise applied to other electrophotographic machines in which the photoconductive belt includes a seam or other incongruity.

Figure 1:
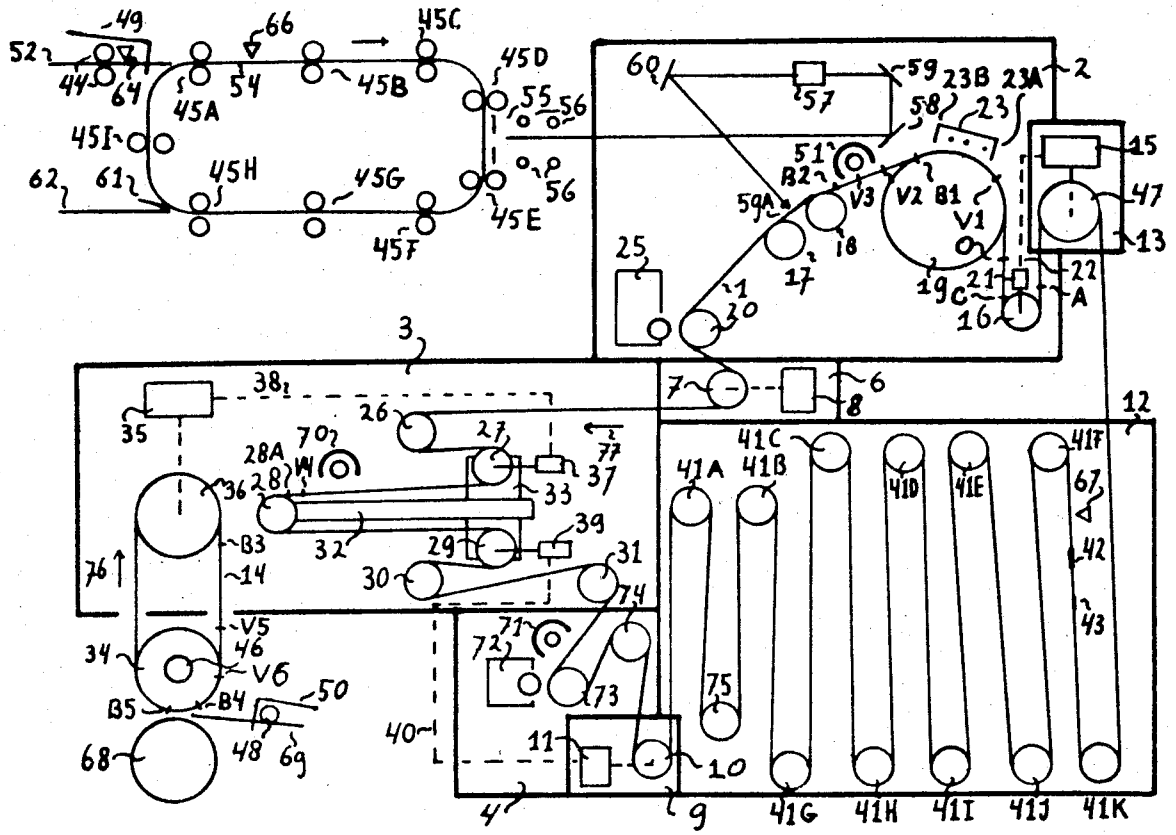
FIG. 1 is a diagrammatic cross-sectional elevation of an electrophotographic apparatus in the form of a copying machine.

FIG. 1 is a cross-sectional diagrammatic elevation of part of a copying machine. An original document to be copied is fed by means of drive rollers 44 along entry path 52 into endless path 54. Stop 49 is provided just past drive rollers 44 to retain an original supplied along entry path 52. Stop 49 can be lifted by an electrically controllable actuating means, not shown. Drive rollers 45A–45I disposed along path 54 move the original along path 54 and past exposure slit 55 at a uniform speed.

A switch 61 is positioned just past rollers 45H which can be set to a first or a second position. In the first position, the original is deflected in the direction of an exit path 62 so that the original leaves path 54. In the second position the original is deflected in the direction of the rollers 45I, so that the original again passes the exposure slit 55.

The portion of the original at slit 55 is exposed by lamps 56. The image of this exposed portion is projected, by means of a lens 57 and mirrors 58, 59 and 60, respectively, onto a photoconductive belt 1 at an exposure station 59A. Belt 1 is advanced in the direction of arrow 77 at a speed which is in synchronization with the speed of the original.

Generally, the path covered by the belt 1 includes an image-forming section 2, in which a powder image is formed on the belt electrophotographically, a first belt drive section 6 in which belt 1 is driven by a drive roller 7 and a synchronous motor 8 connected to the mains supply, an image transfer section 3 in which the powder image can be transferred to an intermediate support 14, a cleaning section 4 in which any powder residues remaining on belt 1 are removed, a second belt drive section 9 in which belt 1 is driven by a drive roller 10 and a servo-system 11, a meander 12 and a third belt drive section 13 in which belt 1 is driven by a drive roller 47 and a servo-system 15. In the image-forming section 2, belt 1 is drawn at a uniform speed by synchronous motor 8 over freely rotatable guide roller 16 and stationary guide rollers 17, 18, 19 and 20, respectively. Guide roller 16 is freely movable vertically. A displacement pick-up 21 is secured to the shaft of roller 16 and delivers a voltage VL3 which indicates the displacement of roller 16 with respect to a predetermined position. The displacement pick-up is so constructed that the magnitude of the voltage VL3 falls when roller 16 is displaced downwardly. Voltage VL3 is delivered via a signal line 22 to servo-system 15.

Servo-system 15 maintains belt 1 at a speed proportional to voltage VL3. Servo-system 15 and displacement pick-up 21 together form a feed-back control system by means of which roller 16 is kept in a state of equilibrium by adjusting the speed of belt 1. Disposed along the path of the belt 1 inside image-forming section 2 are corona charging device 23, projection means 57–60, and a magnetic brush developing device 25. Belt 1 is uniformly charged by means of corona charging device 23. Belt 1 is locally discharged by projecting a light image of the original moving along the exposure slit 55, by projection means 57–60 so that a charge image corresponding to the original is formed on belt 1. A powder image is formed by the magnetic brush developing device 25 by applying powder to the charge image.

In the image transfer section 3, belt 1 is taken along the freely rotatable guide rollers 26–31. Roller 28 is secured to a horizontally movable block 32. Intermediate support 14 is disposed opposite from roller 28. Intermediate support 14 comprises an endless belt, made from silicone rubber, trained over drive roller 36 and guide roller 34. Drive roller 36 is driven in the direction of arrow 76 by servo-system 35. A heating element 46 is disposed inside roller 34 to heat intermediate support 14 via the surface of roller 34.

Roller 28 can be brought into three positions by displacement of block 32, viz.:

a position of rest in which roller 28 is distant from the intermediate support 14;

an auxiliary position in which roller 28 is situated in the direct vicinity of intermediate support 14, but in which belt 1 is not in contact with the intermediate support 14; and a transfer position in which belt 1 is pressed by roller 28 against intermediate support 14 and the powder image is transferred from belt 1 to intermediate support 14.

Rollers 27 and 29 are secured to block 33. Block 33 is mechanically coupled to block 32 such that if block 32 is moved horizontally over a specific distance, block 33 is moved in that same direction, but only over one-half the distance. Consequently, the distance between the exposure station 59A and roller 28, as measured along the path covered by the belt 1, does not change as a result of displacement of roller 28.

Roller 27 and roller 29 are freely movable in the horizontal direction with respect to block 33 which comprise the belt storage means. If roller 28 is in the rest position or the auxiliary position, however, roller 27 is locked in a predetermined position. A displacement pick-up, in the form of potentiometer 37, is secured to block 33 and connected to a voltage source. The slider of potentiometer 37 is secured to the shaft of roller 27. A spring (not shown) is also secured to the shaft of roller 27 to bias roller 27 away from roller 28.

Upon displacement of roller 27, the slider of potentiometer 37 is driven by the shaft of roller 27, so that the voltage at the slider of potentiometer 37 changes (this slider voltage is hereinafter referred to as VL1). This voltage change is an indication of the displacement of roller 27 with respect to block 33. The voltage source is so connected that voltage VL1 decreases when roller 27 is moved towards roller 28. Voltage VL1 is delivered via a signal line 38 to servo-system 35. By means of voltage VL1, servo-system 35 controls the speed of roller 36 in such a way that the speed of belt 14 is kept equal to the speed of belt 1. Servo-system 35 will be described in detail hereinafter in the description.

A second displacement pick-up in the form of a potentiometer 39 is also secured to block 33 and is connected to a voltage source. The slider of potentiometer 39 is secured to the shaft of roller 29. A spring (not shown) is also secured to the shaft of roller 29 to bias roller 29 away from roller 28. On displacement of roller 29 with respect to block 33, the slider of potentiometer 39 is driven by the shaft of roller 29 so that the voltage at the slider of potentiometer 39 changes (this slider voltage will hereinafter be referred to as a VL2). This voltage change is an indication of the displacement of roller 29 with respect to block 33. The voltage source is so connected that the voltage VL2 decreases when roller 29 is moved towards roller 28.

Voltage VL2 is delivered via a signal line 40 to servo-system 11. Servo-system 11 drives belt 1 at a speed directly proportional to voltage VL2. Servo-system 11 and potentiometer 39 together form a feedback control system by means of which roller 29 is maintained in a position of equilibrium with respect to block 33 by adjustment of the speed of belt 1.

Light source 70 is positioned above belt 1 between the rollers 27 and 28 in order to reduce the adhesion of the powder image to the belt 1. Disposed opposite roller 34 is pressure roller 68 which can be pressed against intermediate support 14 by an actuating means (not shown). A sheet of paper can be fed between the rollers 34 and 68 along a paper conveying path 69 by means of conveyor roller 48. Just past conveyor roller 48 is disposed stop 50 which can be raised or lowered by an actuating means (not shown). In the low position, any sheet of paper fed via path 69 is retained by stop 50.

A cleaning brush 72 is provided in cleaning section 4 opposite roller 73 to remove any powder residues remaining on belt 1. Before belt 1 reaches brush 72, the belt is exposed by lamp 71, whereby any charge residues on belt 1 are removed. After roller 73, belt 1 is fed via a roller 74 to drive section 9 and then to meander 12. Meander 12 consists of a number of rollers 41A–41K and a vertically, freely movable roller 75 over which the belt 1 is taken.

To control the copying process, a number of detectors are provided, namely, detector 64 which detects the presence of an original in the entry path 52, detector 66 disposed at a predetermined distance from slit 55 to detect the presence of a passing original, and detector 67 in the meander 12. Detector 67 is disposed at a predetermined distance from exposure station 59A to detect a marker 43 applied on belt 1. Marker 43 is positioned at a predetermined distance from seam 42 present in belt 1.

Figure 2:
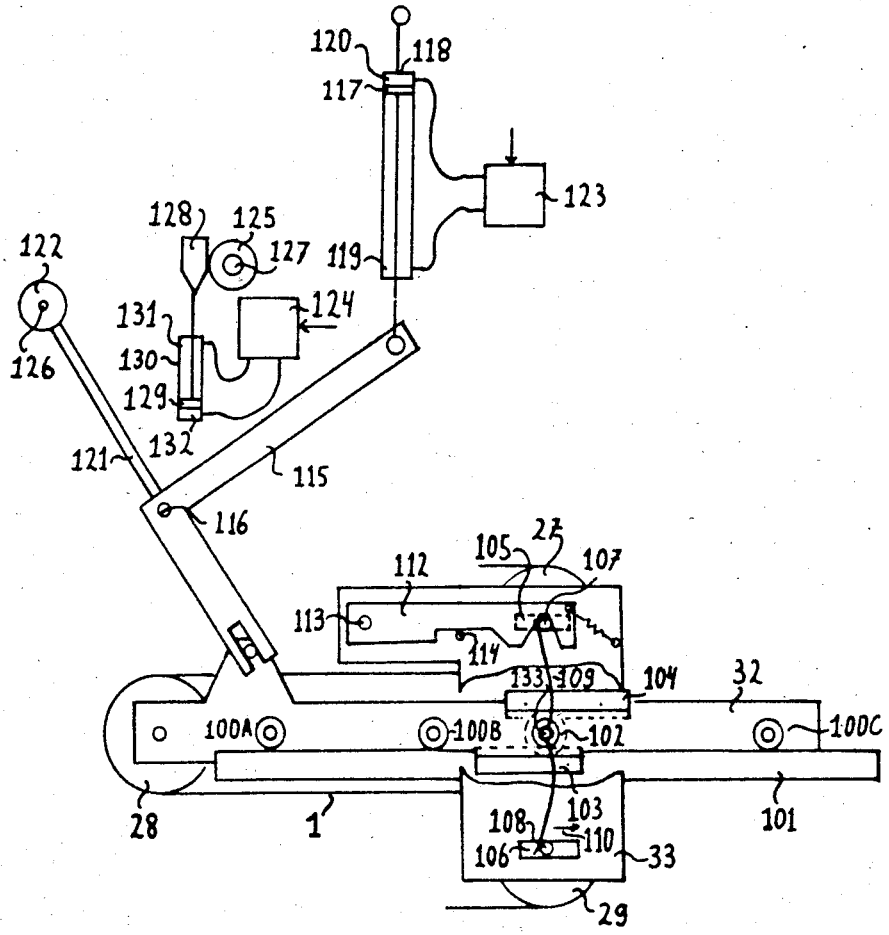
FIG. 2 represents an elevational view of the image transfer section of the copying machine in diagrammatic detail.

Referring to FIG. 2 image transfer section 3 is shown in detail. Freely rotatable rollers 100A–100C are secured to block 32 and rest on guide 101 secured to the frame of the copying machine, so that block 32 can be displaced horizontally with little friction. A first rack 103 is secured to guide 101. A gearwheel 102, the shaft of which is mounted in block 33, engages rack 103. Gearwheel 102 also engages a second rack 104 secured to block 32. When block 32 is displaced a specific distance with respect to guide 101, gearwheel 102 and hence block 33 are displaced over half the distance as a result of the displacement of rack 104.

Shafts 107 and 108 of rollers 27 and 29 respectively are freely movable horizontally in slots 105 and 106 respectively in block 33. A force is exerted in the direction of arrow 110 at each end of the shafts 107 and 108 by means of a torsion spring 109. Each torsion spring 109 is freely rotatable about a shaft 133 secured to block 33 midway between the ends of the shafts 107 and 108. The tension in the belt 1 before and after roller 28 is substantially identical as a result of the above steps.

A latch 112 is secured to shaft 113, the latter being mounted in block 33 so as to freely rotatable. Latch 112 is formed with a notch by means of which shaft 107 can be set at a predetermined place with respect to block 33. A pawl is secured to the frame of the copying machine and co-operates with an inclined portion of latch 112. When block 33 is moved to the left pawl 114 presses against the inclined portion so that latch 112 is pressed up. Shaft 107 is thus unlocked so that it becomes freely movable in slot 105.

A toggle lever 115 is pivotable about a shaft 116 secured to the frame of the copying machine. One end of the toggle lever 115 is coupled to block 32 and the other end of toggle lever 115 is connected via a rod to piston 117 which is freely movable in cylinder 118. The end of cylinder 118 is secured to the frame of the copying machine. Either the bottom part 119 or the top part 120 of cylinder 118 can be pressurized by means of electrically controllable actuating means 123.

Connected to lever 115 is rod 121. Attached to the other end of rod 121 is shaft 126 about which roller 122 is freely rotatable. Adjacent to roller 122 is roller 125 which is freely rotatable about a shaft 127 which is secured to the frame of the copying machine. Wedge 128 is located between rollers 122 and 125 and rests against roller 125 on one side. A piston 129 is secured to the wedge and co-operates with a cylinder 130 secured to the frame of the copying machine. Either the top part 131 or the bottom part 132 of cylinder 130 can be pressurized by means of an electrically controllable actuating means 124.

Cylinder part 119 and cylinder part 131 are pressurized by actuating means 123 and 124, respectively, in the positions represented in FIG. 2. Roller 128 is then in the rest position and as soon as pressure is applied to upper cylinder 120 by actuating means 123, piston 117 is pressed out of cylinder 118 so that pivoting of the toggle lever 115 causes block 32 and hence also block 33 to be displaced to the left with respect to FIG. 2. When roller 122 driven by lever 115 and rod 121 reaches wedge 128, any further pivoting of the toggle lever 115 is counteracted.

The roller 28, secured to block 32, is then in the auxiliary position. In this position block 32 has not yet been moved to the left to such an extent that latch 112 is pressed upwardly by pawl 114, so roller 27 remains locked. When cylinder part 132 is then pressurized, wedge 128 is raised by piston 129 such that roller 122 is no longer retained by wedge 128 and toggle lever 115 is pivoted further in the clockwise direction as a result of the pressure in cylinder part 120, until roller 28 is pressed by block 32 against intermediate support 14. Roller 28 is then in the transfer position. Block 33 is displaced in these conditions to such an extent that pawl 114 presses latch 112 up so that shaft 107 becomes freely movable in slot 105.

B. Belt drive

In the copying machine described with respect to FIG. 1, the path traversed by the belt 1 is divided into three sections. In each section, belt 1 is advanced by a separate drive system. These sections are:

the section between roller 16 and roller 7, where belt 1 is advanced by synchronous motor 8;

the section between roller 26 and drive roller 10, where belt 1 is advanced by servo-system 11; and the section between roller 41A and drive roller 47, where belt 1 is driven by servo-system 15.

The tension in belt 1 in the section between roller 16 and roller 7 is determined by the force with which the roller 16 is pressed down. In the example described here, roller 16 is a roller moving freely in the vertical direction so that the belt tension in this section, except for a small deviation due to friction, is determined by the weight of roller 16. The tension of belt 1 in meander 12 is determined by the weight of the roller 75, which is freely movable in the vertical direction. In the section between roller 26 and roller 10, if belt 1 is not in contact with belt 14 and if roller 27 is locked, the tension of belt 1 is determined by the force with which the ends of torsion springs 109 press against the ends of shaft 108 of roller 29. If roller 28 has been brought to the transfer position so that belt 1 is pressed against belt 14 and roller 27 is unlocked, the belt tension between roller 28 and roller 10 is still determined by the force with which torsion springs 109 press against shaft 108 of roller 29. However, in that case, the belt tension in the section between roller 26 and roller 28 is determined by the force with which torsion springs 109 press against the shaft 107 of roller 27.

Since the torsion springs are disposed freely rotatable in the middle between the slots 105 and 106, the belt tension in the transfer position before and after the roller 28 is substantially identical. One of the results of this is that the frictional force required to advance the belt 1 and exerted thereon by belt 14 at the transfer zone is very low, so that the wear on the belts is low and any vibrations in belt 1 at the transfer zone, which would have an adverse effect on the quality of the transferred image, are avoided. As a result of the above steps, the belt tensions in the separate sections are independent of one another. It is thus possible to select optimum belt tension for each section. Also, vibrations in the belt in one section have little effect, if any, on the other sections. This is important particularly in respect to the image-forming part 2, where belt 1 has to be advanced at a very uniform speed at exposure station 59A, since speed variations (due to vibrations) result in an unsharp copy. The average speed in the sections between roller 26 and roller 47 is made equal to the speed of the belt 1 in the image-forming part 2 by means of servo-systems 11 and 15. Servo system 15 controls the speed of belt 1 at roller 16 in such a manner that roller 16 is held in a predetermined position. This means that belt 1 is taken to roller 16 by servo-system 15 at a speed equal to the speed with which belt 1 is moved by motor 8. Similarly, servo system 11 keeps the speed at which belt 1 is taken away from roller 29 equal to the speed at which belt 1 is taken to roller 29.

C. Image forming

Copies of an original fed past exposure slit 55 can be made by means of the above-described copying machine. To this end, to form one copy, a powder image is formed on belt 1 by successively charging, exposing and applying powder to belt 1. When the powder image approaches roller 28, the latter is brought into the transfer position so that belt 1 is pressed against belt 14. When the powder image then passes through the pressure zone between rollers 28 and 36, it is transferred to belt 14. The transferred powder image is heated while it is driven by the intermediate support 14. In these conditions the powder particles soften so that the image is tacky when it approaches roller 34.

In the meantime, a cutting means (not shown) has cut a sheet of paper from a paper reel to the length of the powder image. The length of the sheet is derived from the length of the original which is in turn determined in path 54. The cut-off sheet is taken along path 69 where it is retained by stop 50. As soon as the softened powder image approaches roller 34, stop 50 is raised so that the waiting sheet of paper is fed between the rollers 34 and 68. Also, roller 68 is pressed against belt 14. When the sheet and the powder image on belt 14 subsequently pass through the pressure zone between the rollers 34 and 68 the softened (and tacky) image material is pressed into the paper. After cooling the image will be firmly bonded to the paper and, thus, fixed.

D. Control of copying machine

Figure 3:
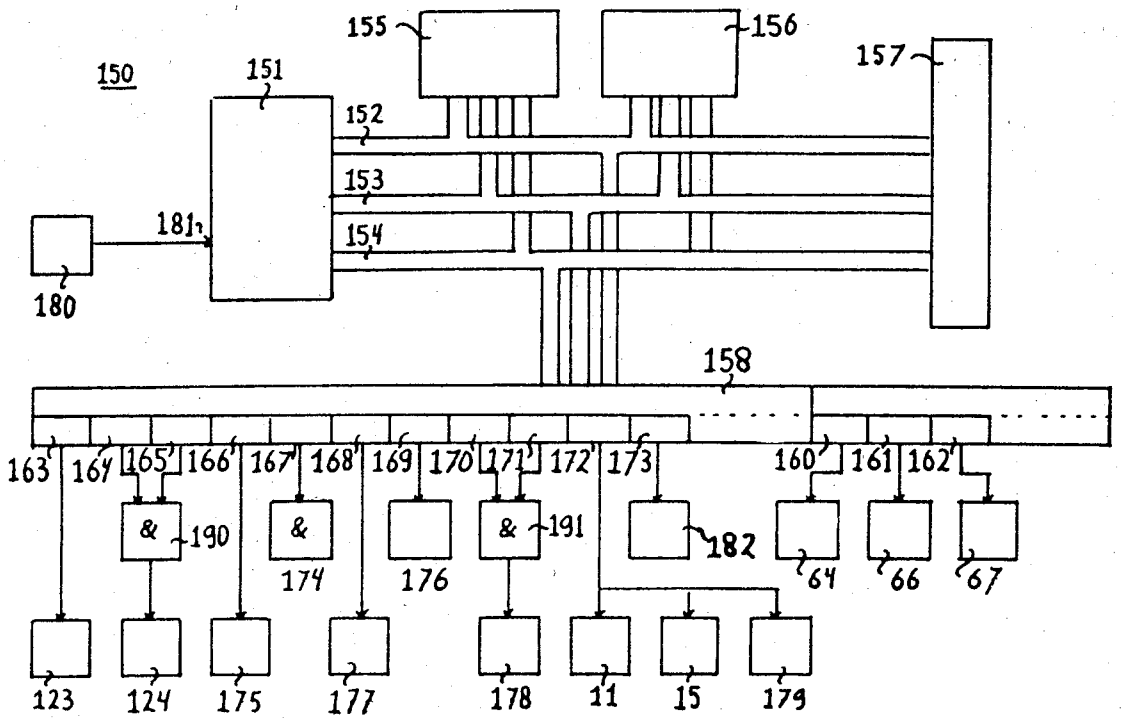
FIG. 3 is a block diagram of a control device for controlling the copying machine.

The actuating means for displacing rollers 28 and 68 and raising and lowering stop 50 and switching the corona device on and off are controlled by control device 150 which is described in reference to FIG. 3. The times at which rollers 28 and 68 have to be displaced, stop 50 has to be raised or lowered, and the corona device has to be switched on or off, are related to the location of the copy under formation on belt 1 or belt 14. These times are hereinafter referred to as "action times" and the operation required to be carried out at a time is hereinafter referred to as an "action."

In order to determine these action times, the control system for each copy under formation registers the positions of the leading edge and the trailing edge of the part of belt 1 or belt 14 on which a copy is being formed. These parts are known as the "imaging sections." As soon as the leading or trailing edge of an imaging section reaches a location at which an action is required to be carried out (referred to as the "action location"), the control system delivers the necessary signals to the actuating means or actuating circuits so that the action is carried out through said means or circuits. For example, by means of control device 150:

the corona device 23 is switched on when the leading edge of an imaging section reaches location V1 (see FIG. 1);

corona device 23 is switched off when the trailing edge of an imaging section reaches location B1;

the light intensity of lamps 56 is adjusted as soon as the leading edge of an imaging section reaches location V3;

roller 28 is brought into the transfer position as soon as the leading edge of an imaging section reaches location V4;

roller 28 is brought into the auxiliary position as soon as the trailing edge of an imaging section reaches location B3;

stop 50 is raised as soon as the leading edge of an imaging section reaches location V5;

stop 50 is lowered again as soon as the trailing edge of an imaging section reaches location B4;

roller 68 is pressed against belt 14 as soon as the leading edge of an imaging section reaches location V6; and roller 68 is lowered again as soon as the trailing edge of an imaging section passes location B5;

Before an image is formed, a check is made to determine, as described hereinafter, whether seam 42 comes within the imaging section intended for the formation of the image. If seam 42 comes within an imaging section, a so-called dummy copy is formed. Upon forming a dummy copy, the imaging section, after being charged, is again discharged by a lamp 51 (see FIG. 1) which is disposed between corona device 23 and exposure station 59A along the path traversed by the belt 1. Also, upon forming a dummy copy, stop 50 is not raised so that no paper is fed between rollers 34 and 68. Moreover, upon forming a dummy copy, lamp 51 is switched on at the time that the leading edge of the imaging section reaches location V2 and is switched off at the time that the trailing edge reaches location B2.

With reference to FIG. 3, central processing unit (CPU) 151 of control device 150 is shown. Central processing unit 151 is preferably a conventional type and is connected via data bus 152, address bus 153, and control bus 154, to a read-only memory (ROM) 155, a random access memory (RAM) 156, a control panel 157 for inputting data and displaying the input data in respect of a required copying order, and an interface circuit 158.

Interface circuit 158 comprises a number of input gates 160, 161 and 162 and a number of output registers 163–173. Via address bus 153, central processing unit 151 can select one of the input gates 160, 161 or 162 or one of the output registers 163–173. Via data bus 152, central processing unit 151 can read the input signals of the selected input gate or load a selected output register. The loading or reading process is controlled by central processing unit 151 via control bus 154. The inputs of input gates 160, 161 and 162 are connected to detectors 64, 66 and 67, respectively.

The outputs of output registers 163, 166, 167, 168, 169 and 173 are connected to the control inputs of actuating means 123, an actuating means 175 for raising stop 50, an actuating means 174 for raising roller 68, an actuating means 177 for switching lamp 51 on and off, an actuating means 176 for raising stop 49, an actuating means 182 for actuating switch 61, respectively. The output of output register 172 is connected to the control inputs for switching servo-systems 11 and 15 on and off and an actuating circuit 179 for switching synchronous motor 8 on and off. The outputs of output registers 164 and 165 are connected to the first and second input respectively of a two-input AND gate 190. The output of AND gate 190 is connected to the input of actuating means 124 for bringing roller 28 into the transfer position. Roller 28 is held in the transfer position when the output signal of AND gate 190 is 1; i.e., when each output register 164 and output register 165 is loaded with a 1. The outputs of output registers 170 and 171 are connected to the first and second input respectively of a two-input AND gate 191. The output of AND gate 191 is connected to the input of an actuating circuit 178 for switching the corona device 23 on and off. Corona device 23 is switched on when the output signal of AND gate 191 is 1; i.e., when each register 170 and register 171 is loaded with a 1.

A pulse generator 180 is connected to the program interrupt input 181 of central processing unit 151. Pulse generator 180 delivers pulses P at a frequency proportional to the speed of belt 1 so that a period of the pulse signal corresponds to a constant displacement of belt 1.

Figure 4:
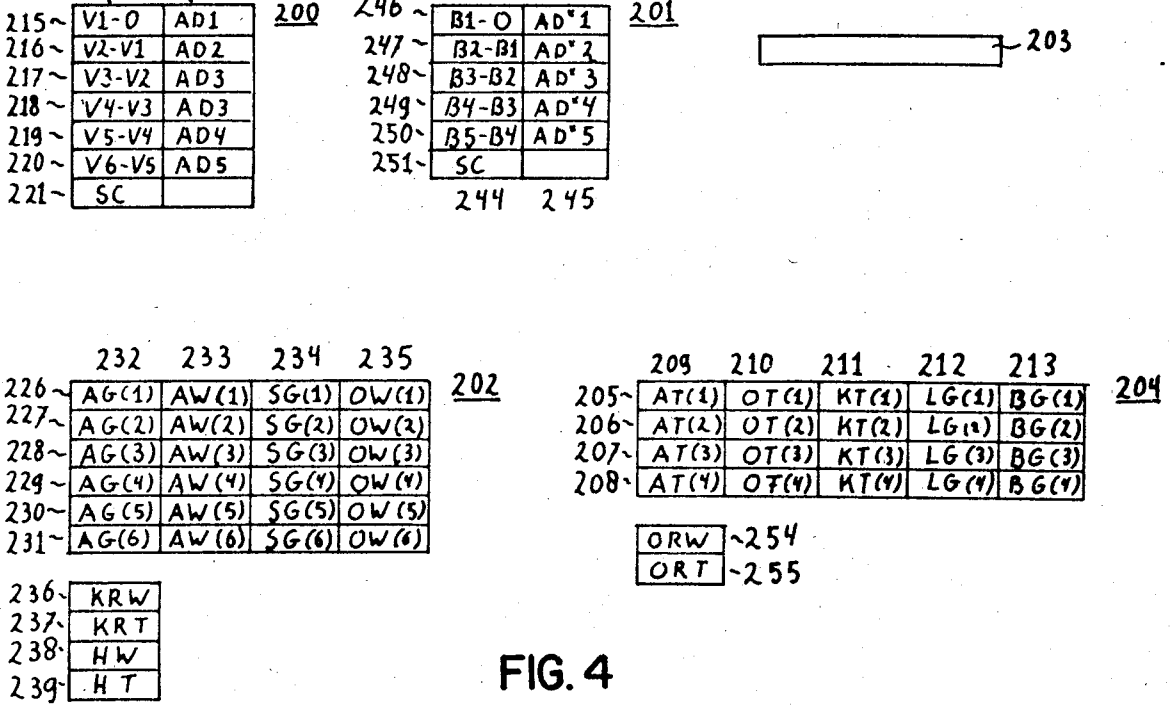
FIG. 4 is a number of tables used for controlling the copying machine.

In order to control the copying process, central processing unit 151 carries out a program stored in the read-only memory 155. Depending upon the copying order inputted via the control panel, the signals delivered by detectors 64, 66 and 67, and the stages of the various copies under formation, central processing unit 151 switches the means and devices required to form the copy on or off. For the purpose of performing each action, depending on whether it is a switching-on or switching-off action, the program comprises a switch-on action routine or a switch-off action routine. During the performance of a switch-on action routine or a switch-off action routine, the output register in question is loaded with a 1 or a 0, respectively. To determine the action times, central processing unit 151 uses a leading edge action table 200, a trailing edge action table 201 and a copy table 202 (see FIG. 4). Central processing unit 151 also uses a seam position register 203 for registering the position of seam 42 and an order table 204 for storing the data of the copy orders in progress (FIG. 4). Seam position register 203 consists of a memory location in the random access memory 156. Seam position register 203 contains a number which indicates the distance between marker 43 and detector 67. This distance is expressed as a number of periods of pulses P. Order table 204 consists of a number of memory locations with consecutive addresses in random access memory 156. The order table is used for storing the data copying orders. A copying order of this kind, for example, comprises making a set number of copies of an original with a set exposure intensity. The order table is divided into a number of rows 205–208 and a number of columns 209–213. Each row can be used to store the data of one copying order, for example:

in column 209 the required number of copies;

in column 210 the number of times that the original still has to be taken past exposure slit 55; in column 211 the number of copies remaining to be finished;

in column 212 the length of the copies to be made; and in column 213 the exposure intensity.

Hereinafter, the memory locations in the columns 209, 210, 211, 212 and 213 will be identified as AT, OT, KT, LG and BG, respectively. Order table 204 also comprises an order row pointer (ORW) denoted by reference 254 and an order row counter (ORT) denoted by reference 255. ORW 254 points to the row containing the data of the latest copy order. The AT, OT, KT, LG, and BG pointed to by ORW 254 are designated AT (ORW), OT (ORW), KT (ORW), LG (ORW) and BG (ORW), respectively. ORT 255 points to the number of orders for which copies are still being formed. ORT 255 is increased by 1 when the data of a new copying order to be executed are input to order table 204, and ORT 255 is reduced by 1 when all the copies of a copying order have been finished.

When a new copying order is introduced, the contents of ORW 254 are first increased by 1 and then the data of the new copying order are stored in the row pointed to by the adjusted ORW 254. However, if before the increase, ORW 254 points to the last row 208 of order table 204, the data of the new copying order are stored in the first row 205 and ORW 254 is so adjusted that it points to the first row after the adjustment. Accordingly, the order table obtained as described above always contains the data for those orders for which copies are under formation.

Leading edge action table 200 consists of a number of memory locations with consecutive addresses in read-only memory 155. The table is divided into a number of rows 215–221 and two columns 222 and 223.

In leading edge action table 200 the distance between locations V1 and V2, V2 and V3, V3 and V4, V4 and V5, and V5 and V6 are fixed in column 222 in the rows 216, 217, 218, 219 and 220, respectively. The distance between location V1 and a location 0 situated at a distance from exposure station 59A corresponding to the distance covered by the belt 1 during the interval of time when the leading edge of an original covers the distance between detector 66 and the slit 55, is also fixed in column 222, row 215. The above distances are expressed as a number of periods of pulses P. In column 223, row 215, 216, 217, 218, 219 and 220, the initial addresses of the action routines for performing the actions associated with the locations V1, V2, V3, V4, V5 and V6 are stored. In column 222, row 211, is stored a stop code SC indicating the end of leading edge action table 200.

Similarly, the distances between locations 0 and B1, B1 and B2, B2 and B3, B3 and B4, and B4 and B5 are fixed in the trailing edge action table 201 in column 244 in rows 246, 247, 248, 249 and 250, respectively. Stored in column 245, rows 246, 247, 248, 249 and 250, are the initial addresses of the action routines for performing the actions associated respectively with the locations B1, B2, B3, B4 and B5, and related to the position of the trailing edge of an imaging section. Stored in column 244, row 251, is stop code SC which indicates the end of the trailing edge action table.

Copy table 202 consists of a number of memory locations with consecutive addresses in random access memory 156. Copy table 202 is divided into a number of rows 226–231 and a number of columns 232–235. In copy table 202, the position of the leading and the trailing edge of the associated imaging section is kept for each copy under formation. Each row in copy table 202 can be used to indicate the position of one leading edge or the position of one trailing edge. By means of the so-called leading edge/trailing edge bit (hereinafter referred to as VAB) it is indicated in the memory location of a row in column 234 (hereinafter referred to as SG), whether the position of a leading or trailing edge is stored in the associated row. A row from the action table indicated by VAB is indicated by the memory location in column 233 (hereinafter referred to as AW). The memory location in column 232 (hereinafter referred to as AG) stores a number which indicates the distance that the associated edge of an imaging section still has to cover before calling on that action routine of which the initial address is stored in the row pointed to by AW in the action table indicated by VAB. These distances are expressed as a number of periods of pulses P. The copy table is updated after each pulse P. The manner in which this takes place is described below.

A row from order table 204 is pointed to by each memory location in column 235 (hereinafter referred to as OW). Copy table 202 also contains a copy table row pointer (KRW) 236, a copy table row counter (KRT) 237, an auxiliary pointer (HW) 238, and an auxiliary counter (HT) 239. The row most recently taken into use from copy table 202 is pointed to by means of KRW 236. The AG, AW, SG and OW pointed to by KRW 236 are hereinafter referred to as AG (KRW), AW (KRW), SG (KRW) and OW (KRW), respectively. KRT 237 indicates the number of rows in copy table 202 which are in use. For each copy required to be formed, two rows are taken into use in the copy table 202. The position of the leading edge of the imaging section is registered in one row and the position of the trailing edge of the imaging section is registered in the other row. When a row is put into use, the contents of KRW 236 are first increased by 1 and then the row indicated by the adjusted KRW 236 is filled with the necessary data. However, if KRW 236 indicates the last row before the increase, the first row 226 is taken into use and KRW 236 is so adjusted that the first row 226 is indicated after the adjustment.

Also, each time a row is taken into use, KRT 237 is increased by 1. KRT 237 is reduced by 1 if the leading or trailing edge passes location V6 or B5, respectively. The way in which this is performed is described in detail below. In addition to the abovementioned tables 200, 201, 202 and 204 are register 203, a number of memory locations in random access memory 156 (hereinafter referred to as the input memory) are also used to store data for the last copy order input via control panel 157, but not yet started. In the example described here, these data are the number of copies to be made and the required exposure intensity.

The way in which order table 204, copy table 202 and seam position register 203 are updated, and the way in which the action times are determined, are described with reference to the flow diagrams represented in FIG. 5 up to FIG. 13.

Figure 5:
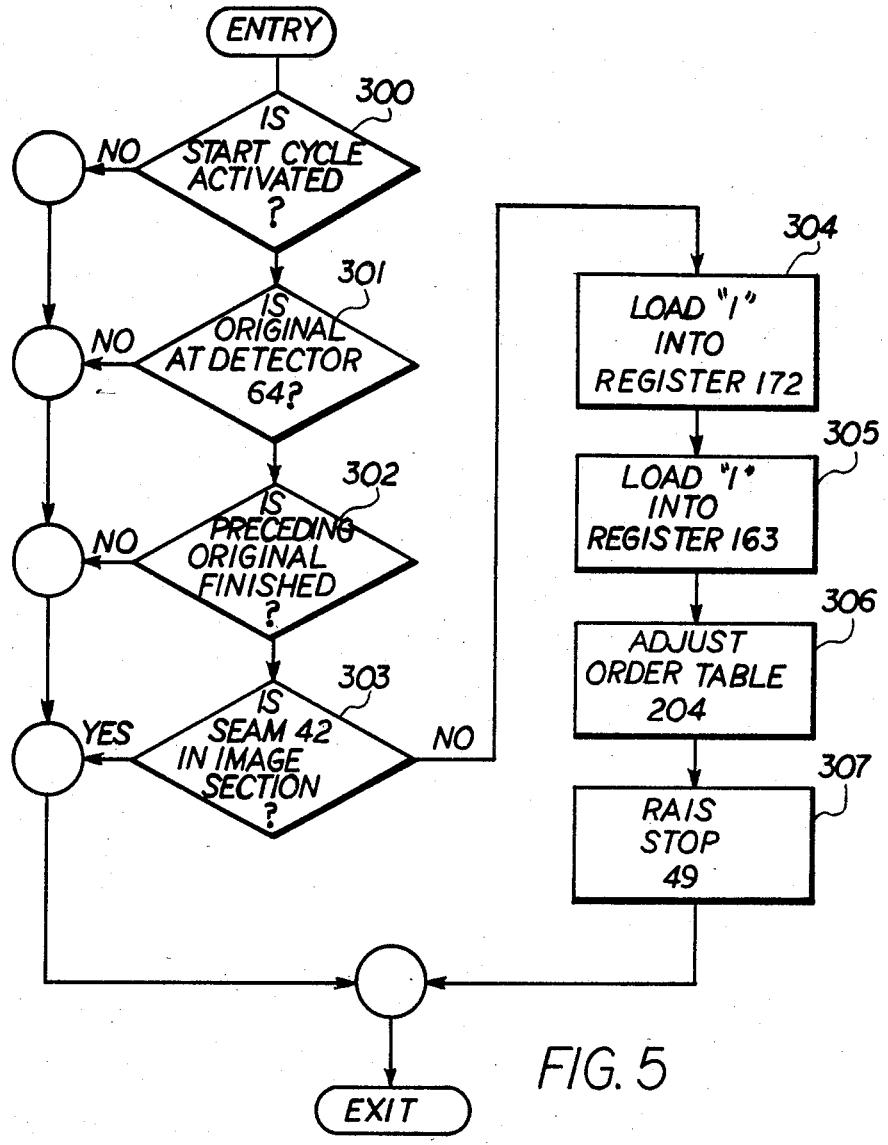
FIGS. 5 to 13 are flow diagrams of the control programs carried out by the control means.

FIG. 5 represents the flow diagram of the original feeding routine for controlling the feeding of an original in endless path 54. The original feeding routine is carried out by central processing unit 151 at regular intervals (e.g. every 100 milliseconds). Initially, a test is made during the performance of step 300 to check whether the start button has been pressed. If it has not been pressed, the original feeding routine is abandoned. If it has been pressed, a test is made during performance of step 301, by means of the detection signal from detector 64, to check whether an original is present at detector 64. If not, the original feeding routine is abandoned as yet. If an original is present a test is carried out during the performance of step 302 to check whether the preceding original has been taken past exposure slit 55 the requisite number of times. For this purpose the contents of the OT (ORW) are used, in which there is an indication of how many times the original of the preceding copy order is still required to be taken past slit 55. If the contents of OT (ORW) are not equal to 0, the original feeding routine is abandoned as yet. If the contents of the associated original counter are 0, step 303 is carried out. During performance of step 303 a test is made to check the possibility that if an awaiting original is introduced into path 54, seam 42 will be situated within its imaging section. For the purpose of ths test, the distance between seam 42 on belt 1 and a predetermined location A along the path traversed by belt 1 (see FIG. 1) is determined from:

the distance between marker 43 and detector 67;

the distance between detector 67 and exposure station 59A;

the distance between marker 43 and seam 42; and the distance between the exposure station 59A and location A.

The distance between marker 43 and detector 67 is registered in the seam position register 203. The distance is expressed as a number of periods of pulses P. The other three distances are stored in the read-only memory 155 and are also expressed as numbers of periods of pulses P. This distance between location A and exposure station 59A is equal to the distance traversed by belt 1 when the leading edge of the original covers the distance between stop 49 and exposure slit 55. If the distance between seam 42 and location A is less than the length of the copy to be formed, then if the original is introduced into endless path 54, seam 42 will come within an imaging section on which the copy will be formed.

The length of the copy to be formed is dependent upon the length of the original. The length of the original is still unknown at the time when the original is introduced. What is known is that the original length may not exceed a specific maximum length which is determined by the length of endless path 54. If the determined distance between seam 42 and location A is less than the copy length corresponding to the maximum original length the original feeding routine is again abandoned. If the determined distance is greater than the distance between seam 42 and location A, steps 304, 305, 306 and 307 are carried out successively before the original routine is abandoned. During the performance of step 304 the output register 172 is loaded with a 1. If output register 172 had not yet been loaded with a 1, and belt 1 therefore had not yet been advanced by the servo-systems 11 and 15 and the synchronous motor 8, the servo systems 11 and 15 and the synchronous motor 8 are thus switched on. If the output register 172 had already been loaded with a 1, belt 1 had already been driven by the servo-systems 11 and 15 and the synchronous motor 8. In that case, there is no change in the drive of belt 1 as a result of loading register 172.

During the performance of step 305, output register 163 is loaded with a 1. If output register 163 had not yet been loaded with a 1, and hence roller 28 had not yet been brought into the auxiliary position through the agency of an actuating means 123, piston 117 and cylinder 118, roller 28 is thus finally brought into the auxiliary position. If output register 163 has already been loaded with a 1, roller 28 has already been brought into the auxiliary position. In that case, roller 28 does not change its position as a result of the loading of register 163.

During the performance of step 306, order table 204 is adjusted. First of all, the contents of ORW 254 are increased by 1, so that after adjustment the pointer points to the next unused row in the order table 204. However, if before the adjustment, ORW 254 points to the last row, ORW 254 is so adjusted that after adjustment it points to the first row 205 in the order table 204. ORT 255 is then increased by 1 during step 306. The number of copies to be made and the required exposure intensity are then called from the input memory. The number of copies to be made is stored at AT (ORW), OT (ORW), KT (ORW). The required exposure intensity is stored in BG (ORW). LG (ORW) is loaded with 0.

Figure 6:
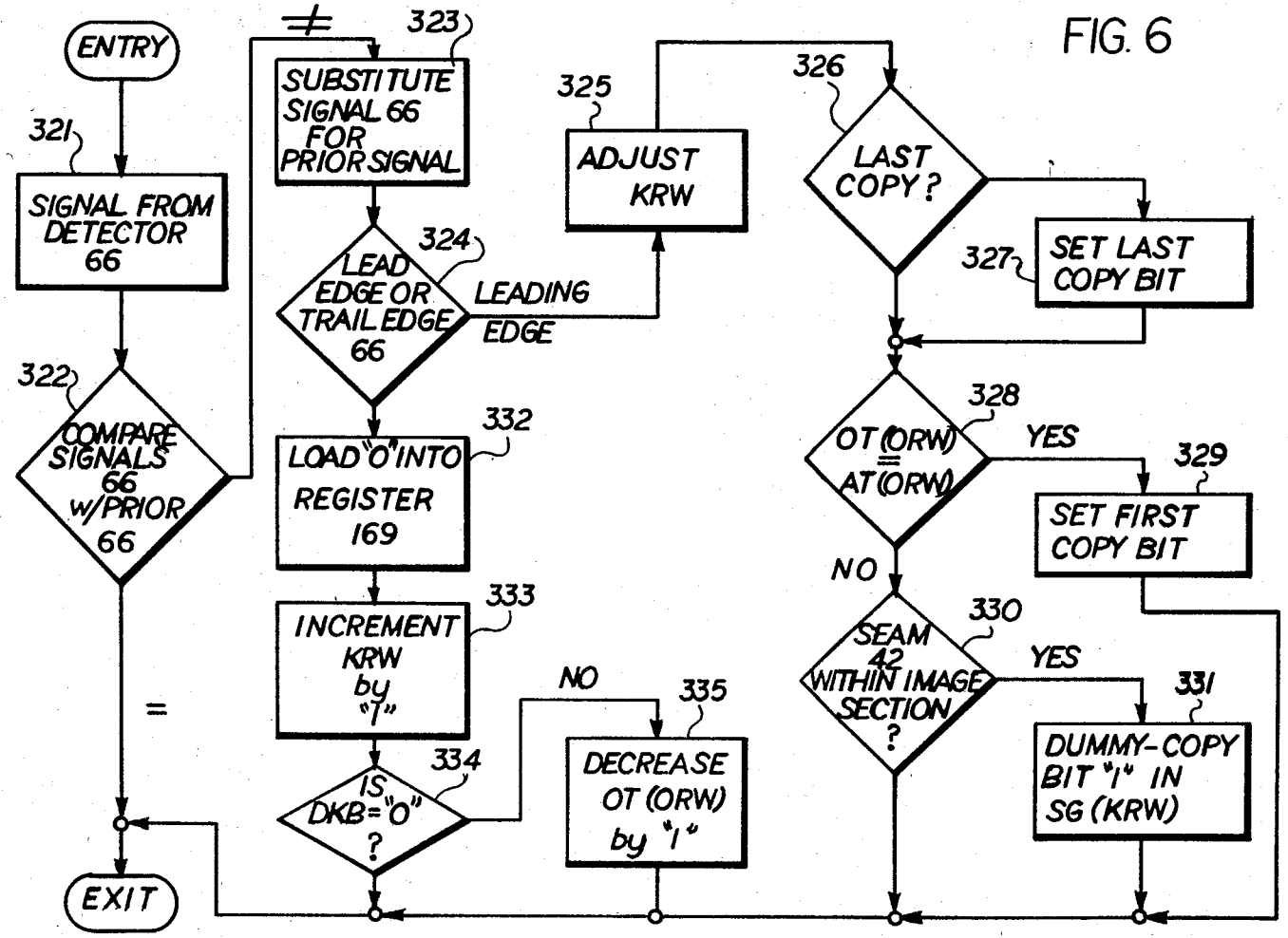

With respect to FIG. 6 a flow diagram of the copy table filling routine is shown. This routine is called up by central processing unit 151 at short intervals (e.g. every 10 milliseconds). The copy table filling routine consists of a number of steps 321–335. By means of the steps 321–324 it is determined whether the leading or the trailing edge of the original has passed detector 66 between two calls on the copy table filling routine. During the performance of step 321, the detection signal of detector 66 is read by central processing unit 151 via input gate 161. The read value is stored in a memory location having a predetermined address in a memory 156. This memory location is referred to as "new 66". During the performance of step 322 the contents of "new 66" are then compared with the detection signal which is determined during the previous call on the copy table filling routine. This detection signal is stored in a memory location having a predetermined address in memory 156. This memory location will hereinafter be referred to as "old 66". If the contents of "old 66" corresponds to the contents of "new 66", the copy table filling routine is abandoned. If the contents of "old 66" and "new 66" do not correspond to one another, then "old 66" is loaded with the contents of "new 66" during the performance of step 323. On the basis of the contents of "new 66", a check is made during the performance of step 324 to determine whether the leading edge or the trailing edge of the original has passed detector 66. If the contents of "new 66" indicate that detector 66 is actuated by the original, the leading edge of the original has passed detector 66 in the interval of time between the penultimate and last call on the copy table filling routine. In that case, step 325 is carried out after step 324. If the contents of "new 66" indicate that detector 66 is not actuated by an original, then the trailing edge of the original has passed detector 66 in the interval of time between the penultimate and last call on the copy table filling routine. In that case, step 324 is followed by step 332.

During the performance of step 325 the contents KRW 236 are increased by 1 so that now KRW 236 points to the next unused row in the copy table 202. However, if before the adjustment, KRW 236 points to the last row 231 from table 202, KRW 236 is so adjusted that after adjustment it points to the first row 226 from copy table 202. AW (KRW) is then loaded in step 325 with the number stored in the first row 215, column 222 of leading edge action table 200, said number indicating the distance between 0 and V1. KRT 237 is also increased by 1. AW (KRW) is so adjusted that, after the adjustment AW (KRW) indicates the first row 215 of leading edge action table 200. OW (KRW) is made equal to ORW 254, which indicates the order for which the copy is to be made. The VAB in SG (KRW) is loaded with 1. The other bits in SG (KRW) are loaded with 0.

The position of the leading edge of a new imaging section is fixed in the way as described above during the performance of step 234 after the leading edge of an original has been detected by detector 66. During the performance of step 326 a test is then carried out to check whether the copy to be formed is the last copy of the order. During this test, the contents of OT (ORW) are called up. If the contents of OT (ORW) are equal to 1, this means that the original will be taken for the last time past exposure slit 55. In that case the copy to be formed is the last of an order, and, then during the performance of step 327, the bit indicating that it relates to the last copy of an order is loaded with 1. This bit will hereinafter be referred to as LKB. After the loading of LKB, the routine is followed by the performance of step 328.

If, during the performance of step 327, it is found that OT (ORW) is not equal to 1, step 326 is immediately followed by step 328. During the performance of step 328, a test is carried out to check whether OT (ORW) corresponds to AT (ORW). If OT (ORW) and AT (ORW) correspond to one another, the copy to be formed is the first of a copying order. In that case, during the performance of step 329 the bit is loaded with a 1 in the status memory indicating that this relates to the first copy of the order, and then the copy table filling routine is abandoned. This bit will hereinafter be referred to as EKB. However, if OT (ORW) and AT (ORW) do not correspond to one another, step 330 is carried out. During the performance of step 330, a check is made to test whether seam 42 comes within the imaging section the position of the leading edge of which was determined during step 325. For the purpose of this test, the distance between seam 42 and a predetermined location C (See FIG. 1) along the path traversed by the belt 1 is determined from:

the distance between marker 43 and detector 67;

the distance between detector 67 and exposure station 59A;

the distance between marker 43 and seam 42; and the distance between the exposure station 59A and the location C.

The distance between marker 43 and detector 67 is registered in a seam position register 203. This distance is expressed as a number of periods of pulses P. The other three distances are stored in the read-only memory 155. These distances are also expressed as periods of pulses P. Central processing unit 151 conventionally calculates the distance between seam 42 and location C from the distances stored in the memory and the contents of seam position register 203. The distance between location C and exposure station 59A is equal to the distance covered by the belt 1 when the leading edge of an original bridges the distance between detector 66 and exposure slit 55. The determined distance between location C and seam 42 is compared with the length of the copy to be formed. This length is stored in LG (ORW). If the determined distance is less than this copy length, seam 42 is situated within the new imaging section. In that case, the so-called dummy-copy bit 1 is made in SG (KRW) during the performance of step 331. The dummy-copy-bit is hereinafter referred to as DKB. The copy table filling routine is then abandoned.

If during the performance of step 324 it is found that detector 66 is not actuated, this means that the trailing edge of the original has passed detector 66 during the interval of time between the last and the penultimate call on the copy table filling routine. In that case, step 324 is followed by the steps 332, 333 and 324. During the performance of step 332, output register 169 is loaded with a 0, as a result of which, if stop 49 had not yet been lowered, stop 49 is finally lowered by actuating means 176.

During the performance of step 333, KRW 236 is increased by 1 so that KRW 236 indicates the next unused row in copy table 202. However, if before the increase KRW 236 pointed to the last row 231 in copy table 202, the KRW 236 is adjusted so that after adjustment the first row 226 of the copy table 202 is the one pointed to. AG (KRW) is then loaded with the number stored in the first row 246, column 244 of trailing edge action table 201, which number indicates the distance between locations B1 and 0. AW (KRW) is adjusted so that after the adjustment AW (KRW) points to the first row 246 in the trailing edge action table 201. The SG (KRW) is loaded with the contents SG of the preceding row in the copy table. VAB in SG (KRW) is then made 0 to indicate that the position in question relates to the trailing edge.

The position of the trailing edge of the new imaging section is fixed in copy table 202 in the manner described above during the performance of step 333, after the trailing edge of an original has passed detector 66.

A test 334 is carried out to check whether DKB in SG (KRW) is 1. If so, the copy table filling routine is abandoned. If not, the OT (ORW) is reduced by 1 and the copy table filling routine is abandoned. If the original counter becomes 0, switch 61 is actuated by means of a routine (not described) such that the original will leave path 54 via switch 61.

Figure 7A:
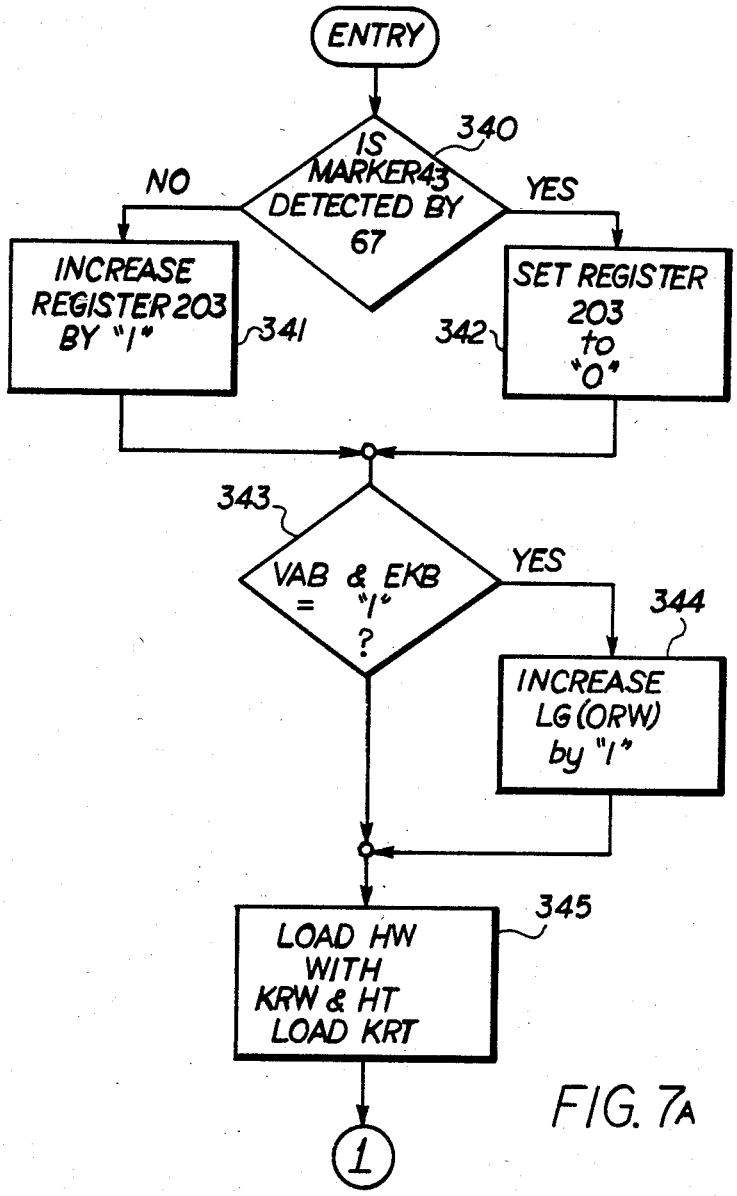
Figure 7B:
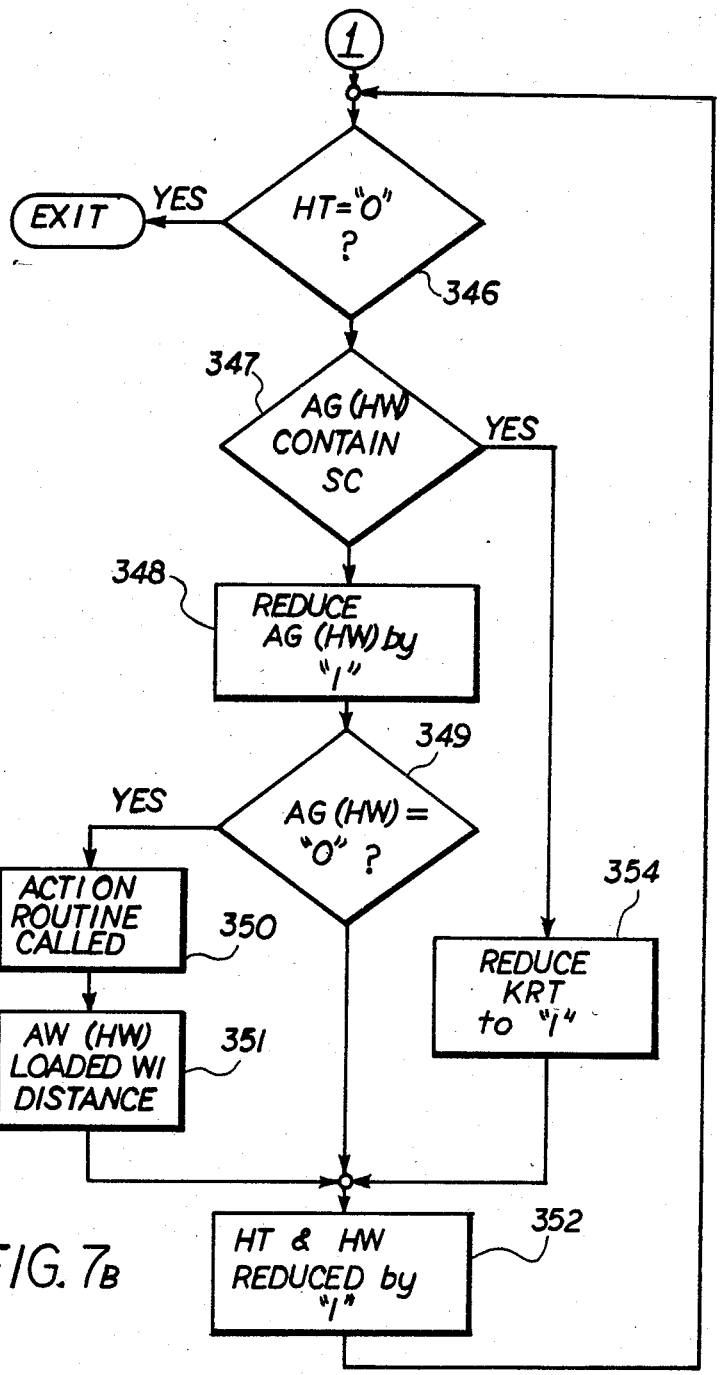

FIGS. 7A and 7B represent the flow diagram of a routine for updating copy table 202. This routine is referred to as the copy table updating routine which is called on whenever pulse generator 180 delivers a pulse on program interrupt input 181 of central processing unit 151. After the call, the contents of seam position register 203 are updated by means of the steps 340, 341 and 342. During the performance of step 340 a test is carried out to check whether marker 43 on belt 1 is detected by detector 67. If so, the contents of seam position register 203 are set to 0 during the performance of step 342. If not, the contents of seam position register 203 are increased by 1 during performance of step 341. After updating of seam position register 203, the length of the first copy of a copy order is determined by means of the steps 343 and 344.

During the performance of step 343 a test is made to check whether VAB and EKB in SG (KRB) are 1. If at least one of these two bits is 0, step 343 is followed by step 345. If both bits are equal to 1, the contents LG (ORW) are increased by 1 during the performance of step 344 before step 345 is carried out. Step 345 is the first step of the part of the copy table updating routine in which the data from the copy table 202 pointing to the positions of the leading and trailing edges of the imaging sections are updated and in which a test is carried out to check whether the leading edge or the trailing edge has reached one of the locations V1–V6 or B1–B5, respectively.

During the performance of step 345, HW 328 is loaded with the contents of KRW 236 and HT 239 is loaded with the contents of the KRT 237. During step 346 a test is then carried out to check whether the contents of HT 239 are equal to 0. If not, a test is carried out during the performance of step 347 to check whether AG (HW) contains the stop code SC. If it does so, the KRT 237, which indicates the number of used rows in the copy table, is reduced to 1 during step 354. In this way the row in copy table 202 containing the stop code SC is released. Step 354 is followed by step 352.

If, during test 347, it is found that the distance memory pointed to by HW 238 does not contain a stop code SC, the contents of AG (HW) are reduced by 1 during step 348 and a test is then carried out during the performance of step 349 to check whether the contents of AG (HW) have become 0 after reduction. If not, step 349 is followed by step 352. However, if the contents have become 0, steps 350 and 351 are carried out before proceeding to step 352. During the performance of step 350 an action routine is called on. The initial address is stored in one of the action tables. VAB SG (HW) indicates the action table in which the initial address is stored. AW (HW) indicates the row of the indicated action table in which the initial address is stored. After the performance of the called action routine, AW (HW) is first increased by 1 so that after the increase AW (HW) points to the next row in the action table. The contents of the memory location in the first column of this row in the action table, which contents indicate the distance to the next action location, is called up and then loaded in AG (HW). Copy table updating routine is then continued with step 352, in which the contents of both HT 239 and HW 238 are reduced by 1. However, if before the increase, HW 238 points to the first row, HW 238 is so adjusted that it points to the last row after adjustment. After the performance of step 352 a test is again carried out during step 346 to check whether HT 239 is equal to 0. If this is not the case, program loop formed by the steps 346–354 is always called up again until the HW has become equal to 0. In that case, all the distances in the distance memories of the unused rows of copy table 202 are updated.

Figure 8:
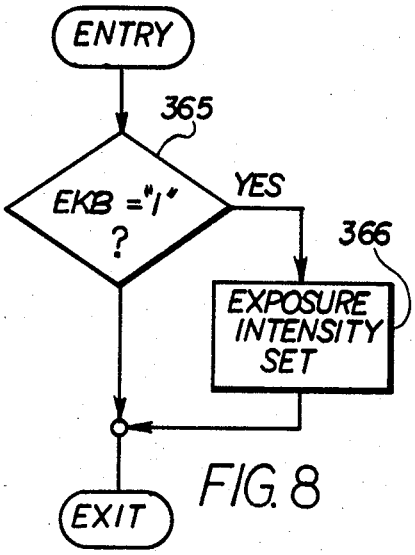

FIG. 8 represents the action routine for adjusting the exposure intensity. This action routine is called as soon as the leading edge of an imaging section reaches location V3. First of all, a test is carried out during step 365 to check whether EKB in SG (HW) is equal to 1. If not, the action routine is abandoned. If it is equal to 1, then during step 366 the required exposure intensity is called from BG of the row in order table 204 storing the data concerning the copy order in question. This row is indicated by OW (HW). Also, during the performance of step 366, the required exposure intensity is set and the action routine is abandoned.

Figure 9:
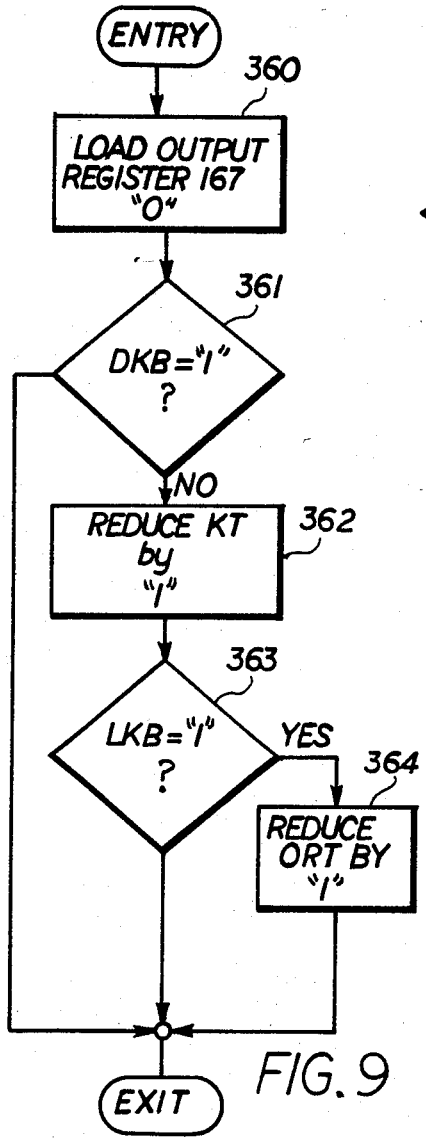

FIG. 9 represents the flow diagram of the action routine for performing the last action in order to form a copy. In the example described here, this is the action routine for lowering roller 68 after the heated powder image has been transferred entirely from belt 14 to the copy material fed via conveying path 69. The action routine represented in FIG. 9 consists of steps 360–364. First of all, step 360 is carried out, in which the output register 167 is loaded with a 0. As a result, roller 68 is lowered through the agency of the actuating means 174 controlled by the output signal of register 167. During the performance of step 361, a test is then carried out to check whether the DKB associated with this copy is 1. If so, the action routine is abandoned. If not, KT of the copy order for which the action is carried out is reduced by 1 during step 362. This copy counter is pointed to by OW (HW). During the performance of step 363 a test is then carried out to check whether the LKB in SG (HW) is 1. If not, the action routine is abandoned. If it is 1, ORT 225 is first reduced by 1 before the action routine is abandoned. In this way, the row in order table 204 containing the oldest copy order for which copies were still under formation is released.

Figure 10:
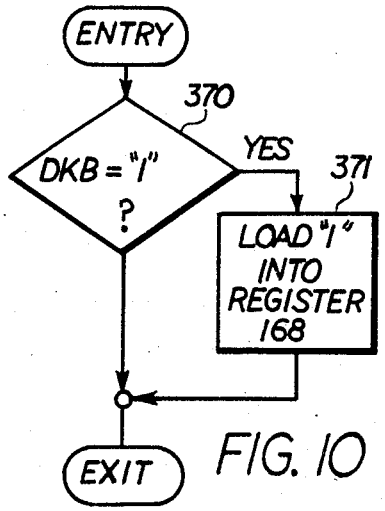

FIG. 10 represents the flow diagram of the action routine for switching on lamp 51. This action routine is called at the time when the leading edge of an imaging section has reached location V2. During step 370, a test is made to check whether DKB in the SG (HW) is 1. If it is not, the action routine is abandoned. If it is 1, however, output register 168 is loaded with a 1 during the performance of step 371. As a result, lamp 51 is switched on so that the portion of belt 1 situated beneath lamp 51 is discharged. In a similar action routine, which will not, therefore, be described in detail, and which is called as soon as the trailing edge of an imaging section has passed location B2, register 168 is again loaded with 0 so that lamp 51 is switched off by means of circuit 177.

Figure 11:
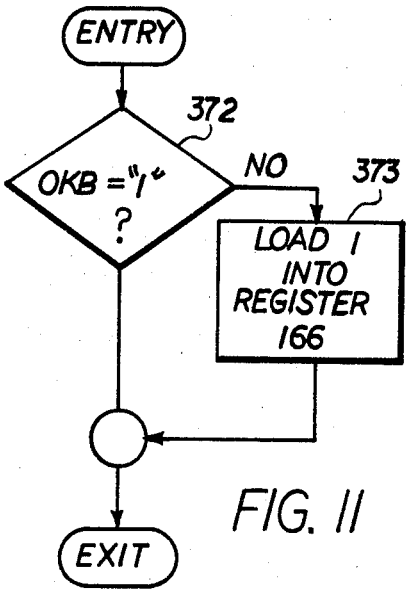

FIG. 11 represents the flow diagram of the action routine for actuating the stop 50 in paper conveying path 69. During the performance of step 372 a test is made to check whether DKB in SG (HW) is equal to 1. If it is, the action routine is abandoned. If it is not, step 373 is carried out before the action routine is abandoned. During step 373, output register 166 is loaded with a 1. Consequently, stop 50 is raised by actuating means 175 so that the waiting copy material resting against stop 50 is fed between rollers 34 and 68.

Apart from the two action routines described above, DKB does not affect the other action routines.

Figure 12:
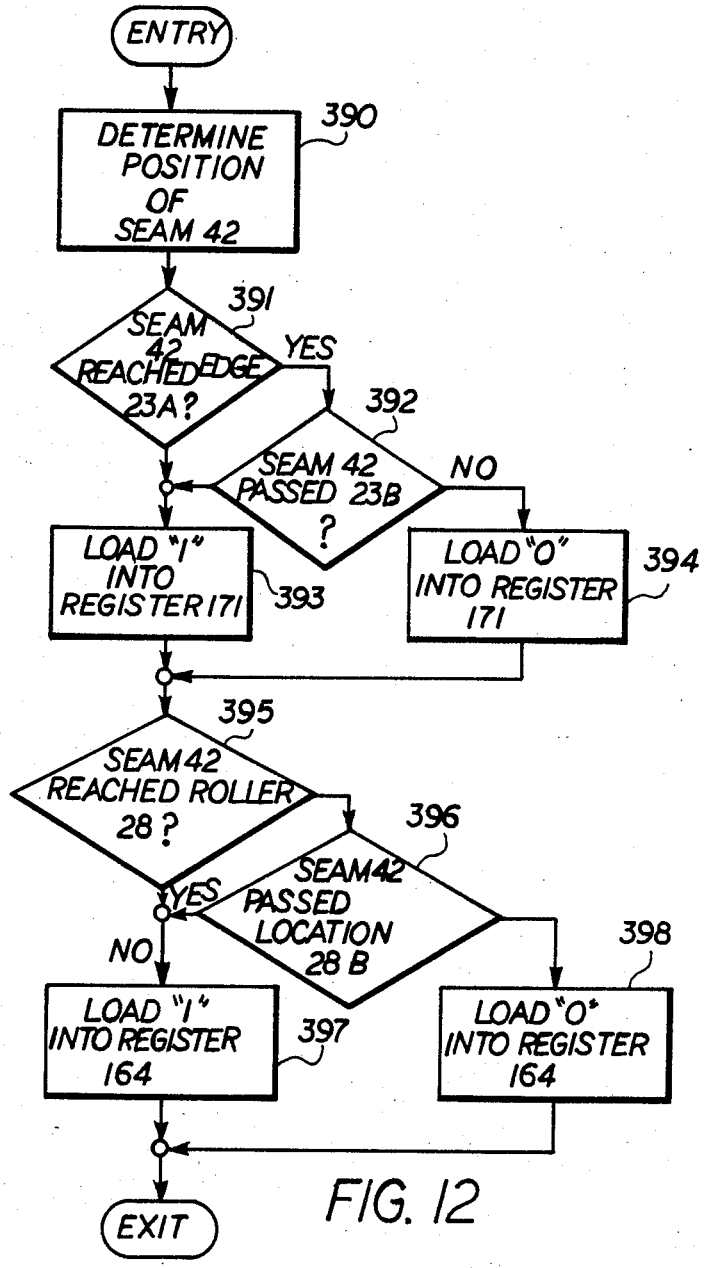

FIG. 12 represents the flow diagram of an action routine for switching off the corona device 23 during the time that the seam 42 is situated beneath the corona device 23 and for bringing roller 28 into the auxiliary position during the time that seam 42 is taken over roller 28. This action routine is called at regular intervals (e.g., every 10 milliseconds) by central processing unit 151. After the call, the position of the seam 42 is first determined, during step 390, on the basis of the distance between marker 43 and seam 42 and the distance between marker 43 and detector 67 where the latter distance is stored in seam position register 203. Steps 391 and 392 are used to determine whether seam 42 is situated beneath corona device 23. In this connection, use is made of the distance between the front edge 23A of corona device 23 (see FIG. 1) and detector 67, and of the distance between the rear edge 23B (see FIG. 1) of the corona device 23 and detector 67. These distances are stored in the read-only memory 155. During step 391, a test is carried out to check whether seam 42 had reached front edge 23A. If it has not, step 393 is performed. If it has, a check is carried out in step 392 as to whether seam 42 is past the rear edge 23B. If it is, step 393 is performed. If not, step 394 is performed. During the performance of step 394 output register 171 is made 0. As a result, the output of AND gate 191 becomes equal to 0 so that corona device 23 is switched off by actuating circuit 178. During the performance of step 393 output register 171 is loaded with 1. As a result, the output of AND gate 191 will become equal to the output signal of output register 172, which output register 172 is loaded during the action routines for switching corona device 23 on and off.

By means of the steps 395 and 396 it is determined whether seam 42 is at roller 28. During the performance of step 395 a test is made to check whether seam 42 has already reached roller 28. For this purpose use is made of the distance between location 28A (see FIG. 1) and detector 67. If seam 42 is situated in front of location 28A, in the part between detector 67 and location 28A, step 397 is performed before the action routine is abandoned. Otherwise, step 396 is performed. On performance of step 396 a test is made to check whether seam 42 is situated past location 28B (see FIG. 1), in the part between location 28B and detector 67. If it is, step 397 is performed before the action routine is abandoned. If not, step 398 is performed before the action routine is abandoned. During the performance of step 398 output register 164 is loaded with a 0. As a result, the output signal of AND gate 190 becomes equal to 0 so that roller 28 is brought into the auxiliary position. During the performance of step 396, output register 164 is loaded with a 1 so that the output of AND gate 190 becomes equal to the output signal of output register 165. For the purpose of bringing roller 28 into and out of the transfer position, output register 165 is loaded in the action routines intended for that purpose.

As already described above, the order counter 215 is increased by 1 during the original feeding routine at the time that a new original is fed into path 54. If the last action for the last copy of an order is performed, the ORT 255 is reduced by 1 during the associated action routines. As soon as the last copy of the last order has been finished, the contents of ORT 255 will accordingly be equal to 0 and in that case belt 1 is stopped during the performance of a so-called belt stop routine.

Figure 13:
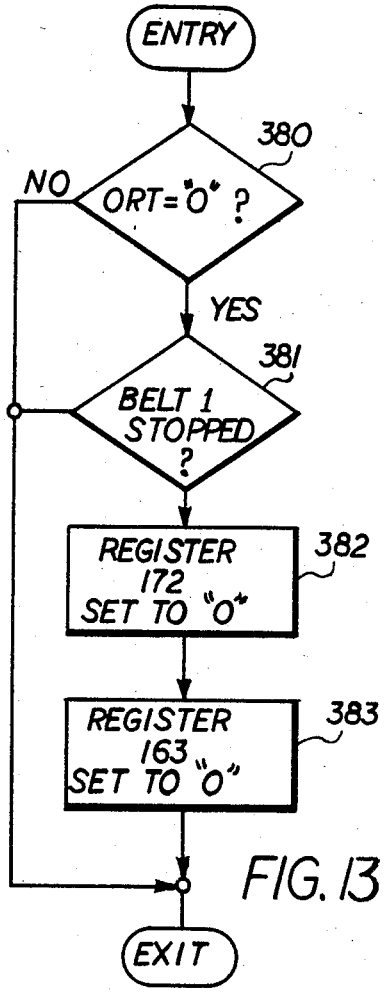

The flow diagram of the belt stop routine is represented in FIG. 13. During the performance of a belt stop routine, which is called at regular intervals (e.g. every 100 milliseconds), a test is carried out during step 380 to check whether the contents of ORT 255 are equal to 0. If not, the belt stop routine is abandoned. If it is, a check is carried out during step 381 to determine whether, if belt 1 is stopped, the first copy formed after restarting belt 1 will be formed on a part of belt 1 containing the seam 42. This possibility exists if the distance between location A along belt 1 and seam 42 is less than the longest permissible copy length.

When determining the distance between location A and seam 42, use is made of the following:

the distance between marker 43 and detector 67, this distance being registered in seam position register 203;

the distance between seam 42 and marker 43; and the distance between detector 67 and exposure station 59A.

These last three distances and also the maximum copy length are stored in the read-only memory 155. If the determined distance is larger than the maximum copy length, steps 382 and 383 are first performed before the belt stop routine is abandoned. During the performance of step 383 output register 172 is loaded with a 0. Consequently, servo-systems 11 and 15 and synchronous motor 8 are switched off so that belt 1 stops. During the performance of step 383, output register 163 is loaded with 0 so that roller 28 is brought into the rest position through the use of actuating means 123, cylinder 118, piston 177 and toggle lever 115.

Figure 14:
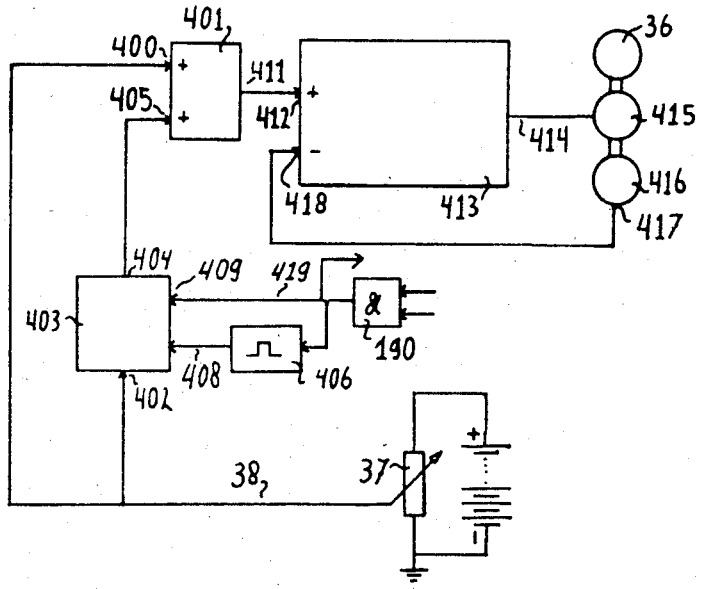
FIG. 14 is the block schematic of the servo-system for driving the intermediate support.

FIG. 14 represents the block schematic of the servo system 35 for controlling the speed of belt 14. Voltage VL 1 at the slider of potentiometer 37 is fed via signal line 38 to a first input 400 of a summation circuit 401 and to an input 402 of a correction circuit 403, the latter being described in detail hereinafter. Output 404 of correction circuit 403 is connected to a second input 405 of summation circuit 401. The control signal 419 originating from AND gate 190 is fed not only to actuating means 124 for bringing roller 28 into the transfer position, but also to an input 409 of correction circuit 403 and to the input of a delay circuit 406. Delay circuit 406, in response to a 1–0 changeover of signal 419, generates a signal 408 of fixed pulse width which is delayed with respect to the 1–0 changeover. Both signal 419 and signal 408 are represented against time in FIG. 16. Output 411 of summation circuit 401 is connected to a first input 412 of a controller 413. A servo motor 415 is energized by a signal originating from an output 414 of controller 413. Servo motor 415 is connected to the shaft of drive roller 36 for driving belt 14. A tachogenerator 416 is also connected to the shaft of servo motor 415. Output 417 of tachogenerator 416 delivers a voltage proportional to the revolutions per second of motor 415. This voltage is fed to a second input 418 of controller 413. By means of this controller 413 the revolutions per second of motor 415 and hence the speed of belt 14 are so controlled in a manner known in control theory that the voltage at the inputs 412 and 418 of controller 413 remain equal to one another. The speed of belt 14 controlled in this way is thus proportional to the voltage Vref at the input 412 of controller 413.

Figure 15:
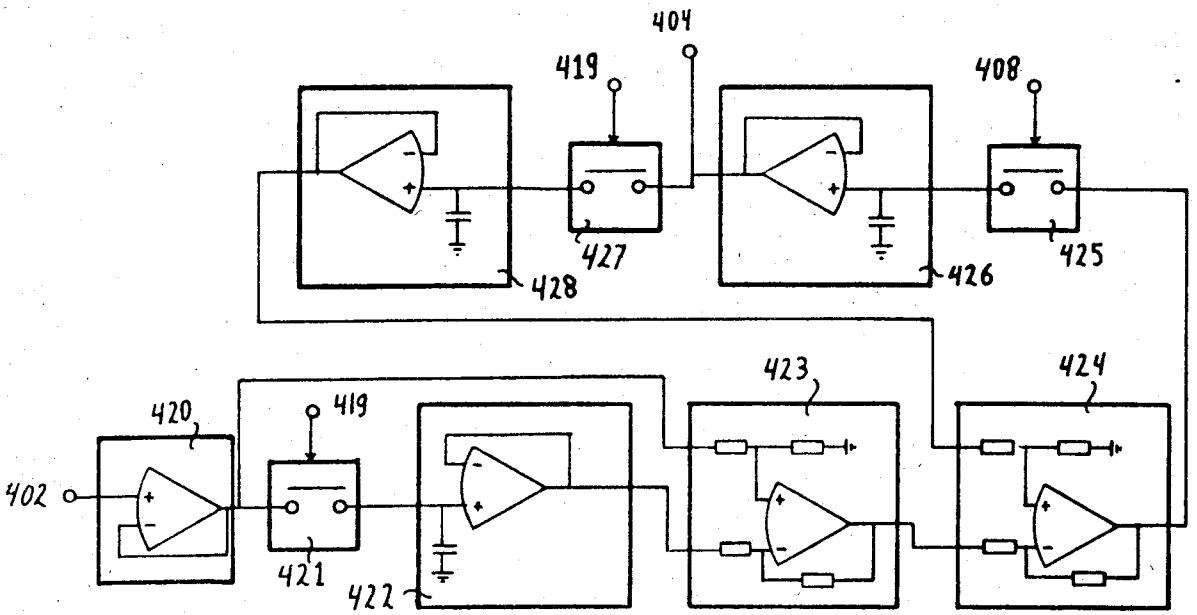
FIG. 15 is a detailed schematic of the correction circuit used in the servo-system of FIG. 14.

FIG. 15 represents the correction circuit 403 in detail. Voltage VL1 is fed to the input 402 of an operational amplifier 420 connected as a voltage follower. The output of amplifier 420 is connected, via an electronic switch 421 actuated by signal 419, to an analog memory circuit 422. The output of amplifier 420 is also connected to the positive input of a subtraction circuit 423. The negative input of subtraction circuit 423 is connected to the output of memory circuit 422. The output of subtraction circuit 423 is connected to the negative input of a second subtraction circuit 424. The output of subtraction circuit 424 is connected, via an electronic switch 425 actuated by signal 408, to a second memory circuit 426. The output of memory circuit 426 acts as the output 404 of correction switch 403. Output 404 is connected, via an electronic switch 427 actuated by signal 419, to the input of a third memory circuit 428. The output of memory circuit 428 is connected to the positive input of subtraction circuit 424.

Figure 16:
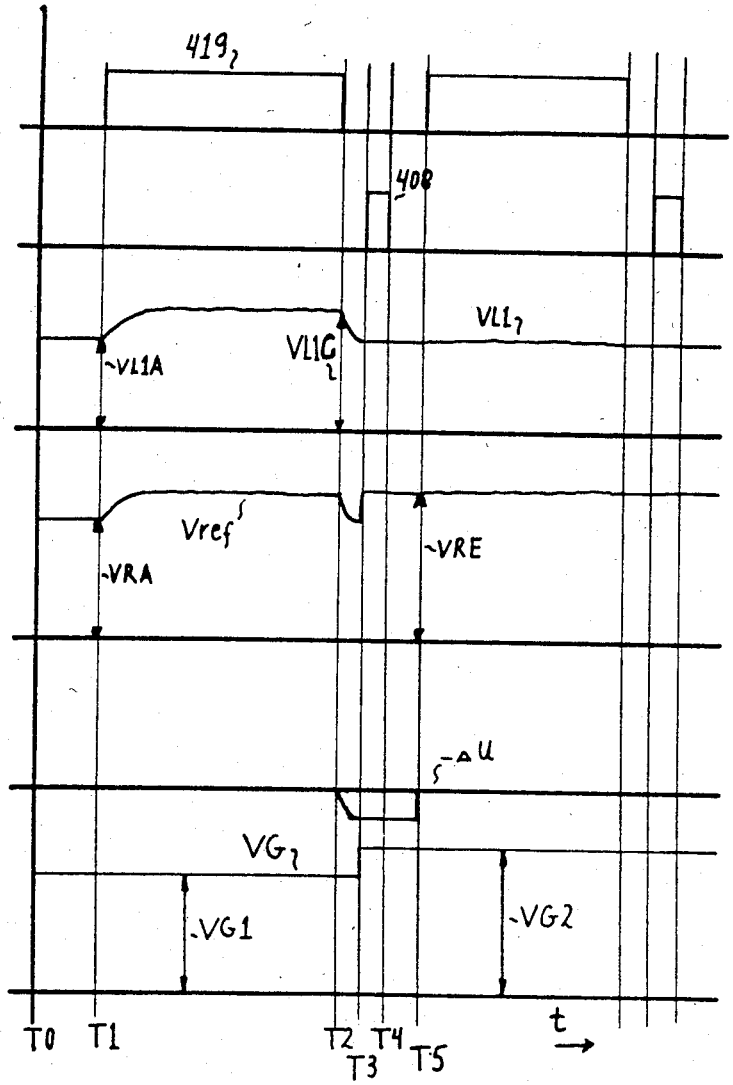
FIG. 16 is a graphical representation of a number of signals plotted against time as generated in the servo-system and delivered to the servo-system of FIG. 14.

The operation of servo-system 15 is described with reference to FIG. 16 and FIG. 17. FIG. 16 represents signals 419 and 408, voltage VL1, voltage Vref, voltage-ΔU at the output of subtraction circuit 423, and voltage VG at output 404 against time.

Figure 17:
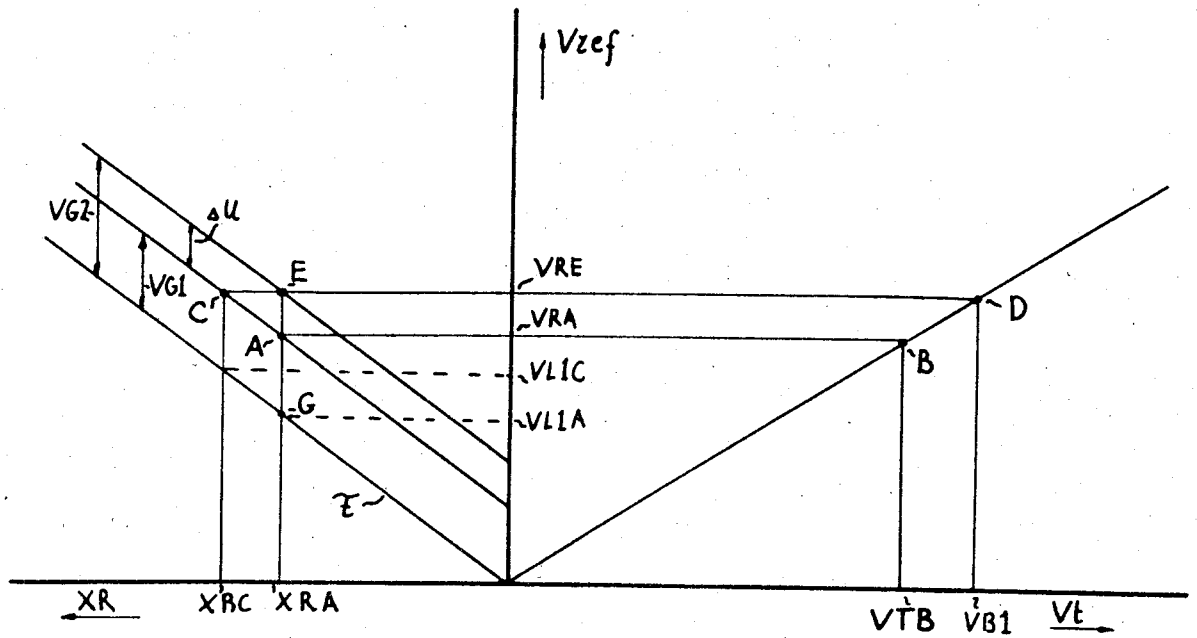
FIG. 17 is a graphical representation of a number of variables occurring in the servo-system of FIG. 14.

FIG. 17 represents the speed Vt of belt 14 against the voltage Vref and, for a number of values of VG, the voltage Vref as a function of the position XR of roller 27 with respect to block 32. Line F denotes Vref as a function of XR for VG=0. In that case Vref is equal to VL1.

Assuming that the output of output register 164 is equal to 1 at time T0, and the output signal for register 166 is equal to 0, then signal 419 will be equal to 0, roller 28 will be in the auxiliary position and roller 27 will thus be locked. XRA in FIG. 17 denotes the position in which the roller 27 is locked. G denotes the voltage VL1A associated with XRA at the slider of potentiometer 37. The voltage VG at the output 404 of correction circuit 403 is equal to VG1.

The voltage Vref (VRA) associated with XRA is accordingly equal to the sum of VL1A and VG1. The speed of belt 14 associated with the voltage VRA is denoted by VTB. In the case under examination here, the speed VTB of belt 14 is not equal to the speed VB1 of belt 1. If at time T1 roller 28 has to be brought into the transfer position, signal 419 will become equal to 1. As a result, the electronic switches 421 and 427 are closed. Also belt 1 is pressed against belt 14. In these conditions, belt 1 assumes the speed VTB of belt 14 at the pressure zone. Since the speed at which belt 14 carries off belt 1 is lower then the speed VB1 at which the synchronous motor 8 supplies the belt 1, roller 27 moves toward potentiometer 37. As a result of this movement, the voltage VL1 and hence also the speed VT of belt 14 increases. The speed VT will continue to increase until roller 27 has moved to such an extent that the voltage Vref has reached a value at which the speed of belt 14 becomes equal to the speed VB1. The position associated with this speed is denoted by XRC in FIG. 17. At time T2 signal 419 again becomes 0 so that switches 421 and 427 are opened. The voltage at the outputs of memory circuits 422 and 428 are thus fixed at a value equal to the value of the output at time T2. This voltage is equal to VG1 for circuit 428 and this voltage is equal to slider voltage VL1C at time T2 for circuit 422. Also, as a result of the 1–0 changeover of signal 419, roller 28 is brought into the auxiliary position and roller 27 is brought back to position XRA in which it is locked. As a result, the voltage VL1 falls off again. The voltage-ΔU at the output of subtraction circuit 423 now indicates the difference between the slider voltage VL1A in the case of a locked roller 27 and the voltage at the output of memory circuit 422, which latter voltage is representative of the slider voltage VL1C as it was at time T2. The voltage at the output of subtraction circuit 424 is now equal to VG1+ΔU. At time T3 signal 408 becomes equal to 1 and the voltage at the output of memory circuit 426 becomes equal to the value VG1+ΔU. Consequently, the voltage Vref increases by a value ΔU, so that Vref again becomes equal to the value of Vref at time T2, at which value the speed VT of belt 14 was equal to the speed VB1. This voltage is denoted by VRE in FIG. 17.

At time T4 signal 408 again becomes 0, so that switch 425 is again opened. Consequently, the voltage at output 404 is fixed at the value VG2. If signal 419 again becomes 1 at time T5, belt 1 will again be brought into contact with belt 14. As a result, belt 1 will again be driven by belt 14. Since the speeds of belt 1 and belt 14 before being brought into contact were already equal to one another, the speed of belt 1 at the pressure zone will not change.

In the way described hereinbefore, if, as a result of a change in the system parameters or for any other reason, the speeds of belt 1 and belt 14 are no longer equal to one another during the interval of time when the belts are disengaged from one another, the output voltage at output 404 will always be so adjusted that after adjustment the speeds of the belts are again equal to one another in the free-running condition. This results in reduced wear on belts 1 and 14. Also, the distance over which an image is entrained by belts 1 and 14 remains always the same, so that the time required to bring an image from exposure station 59A to roller 68 remains always the same and hence the time at which copy material has to be introduced between the rollers 34 and 68 is always known.

The invention has been described in connection with electrophotographic copying machine. However, the invention is equally applicable to other type of copying machines as well as other types of electrophotographic apparatus, e.g., an electrophotographic printing device in which the image formed on the photoconductive belt is built up dot by dot, such as by means of a laser or other point light source. It is also immaterial that an image formed on the photoconductive belt is transferred to the receiving material via an intermediate support. The image formed can equally well be transferred to the image-receiving material directly from the photoconductive belt. Accordingly, the invention may be otherwise embodied within the scope of the appending claims.

What is claimed is:

1. A device for transferring image information present on a belt to an intermediate support, comprising a first drive means which propels the belt at a first speed, a second drive means which propels the intermediate support at a second speed; a pressing element for placing said belt in pressure contact with the intermediate support, whereby said belt assumes the speed of said intermediate support and transfers the image information from said belt to the intermediate support; a belt storage device disposed between the drive means and the pressing element for storing the length difference arising from the difference in the belt speed at the first drive means and at the pressing element, a measuring device to provide a measurement signal which is a measurement of the belt length present in the storage device and an adjusting means which adjusts the second speed in dependence on the length represented by the measurement signal.

2. A device according to claim 1, in which the belt storage device comprises a belt guide roller freely movable in a predetermined direction, and wherein said measuring device comprises a displacement sensor for determining the displacement of the belt guide roller in a predetermined direction.

3. A device according to claim 2, in which the belt storage device is held, outside the time interval during which transfer takes place, in a predetermined state in which the length of the stored belt remains constant and wherein the image transfer device is provided with:

a first memory element for storing the value of the measurement signal at the end of the time interval, a subtracting device which, outside the time interval, determines the difference between the measurement signal and the value stored in the first memory element, a second memory element for storing the determined value during the said time interval, and a summing device which adds the value stored in the second memory element up to the measurement signal before the measurement signal is delivered to the adjusting device.

4. A means for transferring image information from a belt driven at a first speed to a medium driven at a second speed, comprising:

a. a pressing element adapted to be brought into a first position in which said element maintains the belt free from said medium and in a second position in which said belt is maintained in pressure contact in a small zone with the medium to transfer the image and in which zone said belt is allowed to assume the speed of the medium by means of frictional forces;

b. a first and second guide roller disposed on either side of said zone, respectively, and adapted for movement along predetermined paths to exert a tightening force on said belt;

c. a means for positioning said first guide roller into a predetermined position when said pressing element is in its first position, said positioning means comprising a latching device cooperating with said first guide roller, said latching device allowing said first guide roller to move when said pressing element is in said second position or is moving to said position; and d. a means for exerting a force on said latching device when said pressing element has left said second position such that said latching device causes said first guide roller to take said predetermined position and is latched thereat.

5. A device according to claim 4, wherein such latching device includes a plate which is provided with a v-shaped excision, the edges of which cooperate with one end of a shaft on which said first guide roller rotates, said plate being movable along a predetermined path by which movement the v-shaped excision crosses the path of said end of said shaft of said first guide roller; and when said pressing element has left said second position, said exerting means exerts a force on the plate such that the edges of the v-shaped excision are maintained in pressure contact with the said end of the shaft.

* * * * *

UNITED STATES PATENT AND TRADEMARK OFFICE

CERTIFICATE OF CORRECTION

PATENT NO. : 4,592,641

DATED : June 3, 1986

INVENTOR(S) : Johannes C.H. ROELOFS, Bastiaan B.B. EERTINK and Petrus A.M. GEURTS It is certified that error appears in the above-identified patent and that said Letters Patent are hereby corrected as shown below:

Column 5, line 48, after "to" insert -- be --;

Column 10, line 3, after "55;" the phrase "in column 211 the number of copies remaining to be finished;" should be a separate and new subparagraph;

Column 11, line 50, after "the" delete "abovementioned" and substitute therefor -- above-mentioned --;

Column 14, line 14, after "step" delete "234" and substitute therefor -- 324 --; and Column 15, line 3, after "copy" and before "bit" insert -- - --.

Signed and Sealed this

Twenty-third Day of December, 1986

*Attest:*

DONALD J. QUIGG

*Attesting Officer* *Commissioner of Patents and Trademarks*